United States Patent [19]

Noviello, Jr. et al.

[11] Patent Number: 4,972,859

[45] Date of Patent: Nov. 27, 1990

[54] HAIR SECUREMENT DEVICE

[76] Inventors: Ernest A. Noviello, Jr.; Michele W. Noviello, both of 1102 Grathwol Dr., Wilmington, N.C. 28405

[21] Appl. No.: 440,334

[22] Filed: Nov. 22, 1989

[51] Int. Cl.[5] ..... A45D 8/36

[52] U.S. Cl. ..... 132/273

[58] Field of Search ..... 132/273, 275, 333; 40/315; 24/49 CF, 113 R, 113 MP, 90.5, 265 EE, 265 H, 378, 56, 58, 65

[56] References Cited

U.S. PATENT DOCUMENTS

| | | | |
|---|---|---|---|
| D. 220,019 | 2/1971 | Solomon | 132/273 |
| 319,997 | 6/1885 | Paul | 24/90.5 |
| 323,648 | 8/1885 | Eshlemen | 24/56 |
| 1,367,687 | 2/1921 | Doak | 24/90.5 |
| 2,969,070 | 1/1961 | Todfield | 132/273 |
| 3,081,781 | 3/1963 | Stermer | 132/273 |
| 3,099,271 | 7/1963 | Dubelier | 132/273 |
| 3,182,369 | 5/1965 | Lerma | 24/113 R |
| 3,301,266 | 1/1967 | Hoffmann | 132/273 |
| 3,418,194 | 12/1968 | Loffice | 132/251 |
| 3,441,032 | 4/1969 | Barrett | 132/275 |
| 3,751,769 | 8/1973 | Reiner | 132/273 |
| 4,514,882 | 5/1985 | Lavielle | 24/17 AP |

FOREIGN PATENT DOCUMENTS

| | | | |
|---|---|---|---|
| 695410 | 8/1940 | Fed. Rep. of Germany | 132/273 |
| 2289136 | 7/1976 | France | 24/113 MP |

*Primary Examiner*—John J. Wilson
*Assistant Examiner*—Frank A. Laviola, Jr.
*Attorney, Agent, or Firm*—Leon Gilden

[57] ABSTRACT

A hair securement device is set forth utilizing a plurality of spaced spherical securement members each several into cooperative hemispherical portions with spaced projections of a first portion receivable within cavities of a second portion, with medial cavities of each portion formed with projections to secure a semi-rigid tether line therebetween formed with a central malleable core. A modification of the instant invention includes crescent shaped securement members defined by a circular segment internal cavity of an arc greater than 180 degrees defined by spaced tip ends spaced at a distance less than a button diameter, wherein the crescent members are flexible to flexibly and resiliently mount and receive an associated button therewithin.

1 Claim, 4 Drawing Sheets

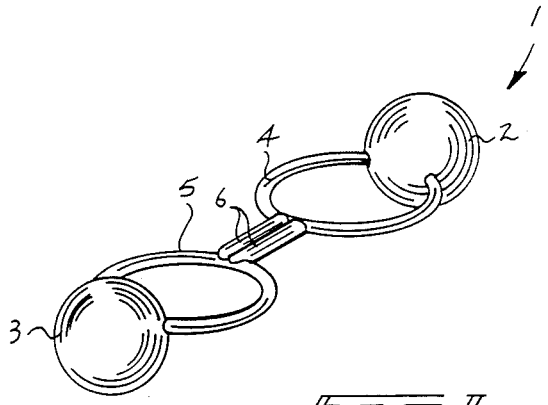
Fig 1
PRIOR ART
Fig 2
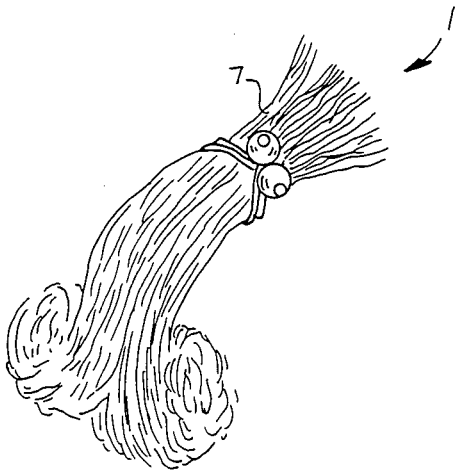
PRIOR ART

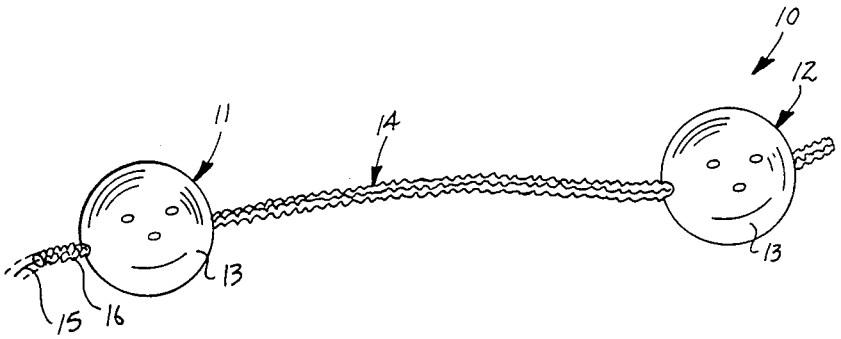
FIG 3
FIG 4
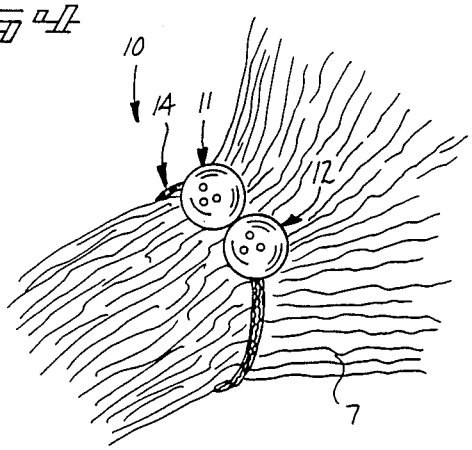

HAIR SECUREMENT DEVICE

BACKGROUND OF THE INVENTION

1. Field of the Invention

The field of invention relates to hair securement devices, and more particularly pertains to a new and improved hair securement device wherein the same is selectively securable about an associated semi-rigid tether line for encompassing a cluster of hair.

2. Description of the Prior Art

The use of various hair securement devices is well known in the prior art. The devices of the prior art normally are of a fixed spacing to accommodate tufts of hair therebetween. The instant invention attempts to overcome deficiencies of the prior art by providing hair securement members that are selectively spaced about an associated hair encompassing tether line. Examples of the prior art include U.S. Pat. No. 3,418,194 to Loftice wherein a decorative flower and holder is utilized for ornamentation of a rolled hair assembly of an individual, wherein the flower holder is of a semi-rigid construction to be received within the hair securement member or roller to enhance the aesthetic use thereof.

U.S. Pat. No. 3,441,032 to Barrett sets forth a hair ornament wherein a malleable elongate base member is provided with serrated ends for securement in association with a hair roller.

U.S. Pat. No. 3,301,266 to Hoffmann provides a hair holding organization wherein spaced spherical members are joined to terminal ends of elastomeric tether line portions for securement of a hair tuft thereabout.

U.S. Pat. No. 3,099,271 to Dubelier sets forth a hair holder formed by a loop whose terminal ends are received within a single nodule for securement of a tuft of hair therewithin.

U.S. Design Pat. No. 220,019 to Solomon provides spaced spherical portions formed with ring members ostensibly of flexible organization for surrounding relationship relative to a tuft of hair.

As such, it may be appreciated that there is a continuing need for a new and improved hair securement device wherein the same is selectively securable about a hair tether line for accommodating hair bundles of various diameters, and in this respect, the present invention substantially fulfills this need.

SUMMARY OF THE INVENTION

In view of the foregoing disadvantages inherent in the known types of hair securement devices now present in the prior art, the present invention provides a hair securement device wherein the same is provided with tether line securement members selectively positionable about the tether line, or alternatively provided with cavities for securement to an article of clothing for temporary storage prior to use. As such, the general purpose of the present invention, which will be described subsequently in greater detail, is to provide a new and improved hair securement device which has all the advantages of the prior art hair securement devices and none of the disadvantages.

To attain this, the hair securement device of the instant invention includes a plurality of pairs of hemispherical members, wherein the hemispherical members comprises a first member defined by a plurality of spaced cavities and a central cavity formed with projections cooperative with a second hemispherical member formed with shafts at bulbous terminal ends receivable within first cavities and formed with a central cavity aligned with the second cavity of the first hemispherical member for securement to the flexible tether line therebetween. A modification of the instant invention includes crescent shaped members defined by a circular segment cavity defining an arc greater than 180 degrees for securement about a button member of a fixed diameter of a distance greater than a spacing defined between flexible tips of the crescent members for securement to the button member for storage thereof prior to use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair securement device which has all the advantages of the prior art hair securement devices and none of the disadvantages.

It is another object of the present invention to provide a new and improved hair securement device which may be easily and efficiently manufactured and marketed.

It is a further object of the present invention to provide a new and improved hair securement device which is of a durable and reliable construction.

An even further object of the present invention is to provide a new and improved hair securement device which is susceptible of a low cost of manufacture with regard to both materials and labor, and which accordingly is then susceptible of low prices of sale to the consuming public, thereby making such hair securement devices economically available to the buying public.

Still yet another object of the present invention is to provide a new and improved hair securement device which provides in the apparatuses and methods of the prior art some of the advantages thereof, while simultaneously overcoming some of the disadvantages normally associated therewith.

Still another object of the present invention is to provide a new and improved hair securement device wherein the same is selectively securable about a hair tether line to selectively form an adjustable hair securement member as desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art device.

FIG. 2 is an isometric illustration of the prior art device of FIG. 1 in securement about an elongate hair bundle.

FIG. 3 is an isometric illustration of the instant invention.

FIG. 4 is an isometric illustration of the instant invention secured about an elongate hair bundle.

DESCRIPTION OF THE PREFERRED EMBODIMENT

Figure 5:
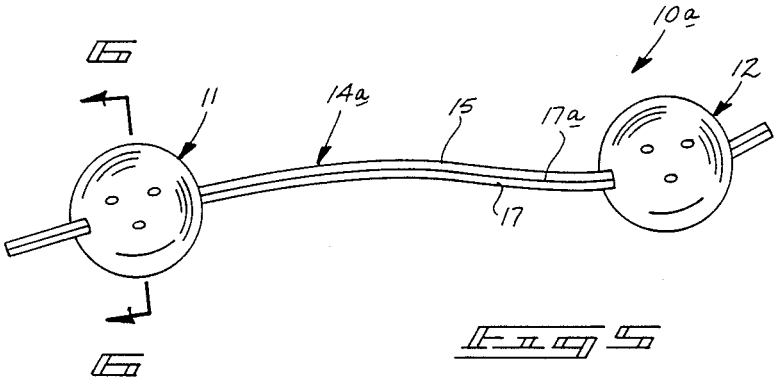
FIG. 5 is an isometric illustration of a modified hair securement device of the instant invention.

With reference now to the drawings, and in particular to FIGS. 1 to 8 thereof, a new and improved hair securement device embodying the principles and concepts of the present invention and generally designated by the reference numerals 10, 10*a*, and 10*b* will be described.

More specifically, the hair securement device 10 defines an improvement over the prior art, as illustrated in FIGS. 1 and 2, wherein the prior art device 1 includes a plurality of spaced spherical members 2 and 3 permanently mounted to resilient ring portions 4 and 5 joined by a common central body, wherein the members are interfitted through a respective ring member for securement of an elongate hair bundle 7 therewithin.

The hair securement device 10, as illustrated in FIG. 3, includes a first cylindrical securement head member 11 spaced from a second cylindrical securement head member 12, each being of identical construction. A decorative illustration 13 is imparted on a forward hemispherical portion of each head to enhance its use and aesthetic appeal. A malleable tether line 14 is fixedly mounted and diametrically directed through each cylindrical head member 11 and 12 and includes a wire core 15 to retain imposed geometric configuration manually imparted to the tether line 14, wherein a cylindrical fabric sheath 16 is in an encompassing relationship relative to the wire core 15 to position the wire core 15 coaxially of the fabric sheath 16. The fabric sheath 16 protects an elongate hair bundle 7 when secured thereabout, as illustrated in FIG. 4, and wherein the coaxially positioned wire core 15 maintains the geometric integrity imparted to the hair securement device 10.

FIG. 5 is illustrative of a modified hair securement device 10*a* which includes the first and second cylindrical securement head members 11 and 12, but secured in a spaced relationship relative to a planar fibrous sheath 17 formed with a medially aligned wire core 17*a* relative to the sheath 17 that maintains an imparted geometric configuration imposed upon the organization when secured about an elongate hair bundle 7 in a similar manner as illustrated in FIG. 4.

Figure 6:
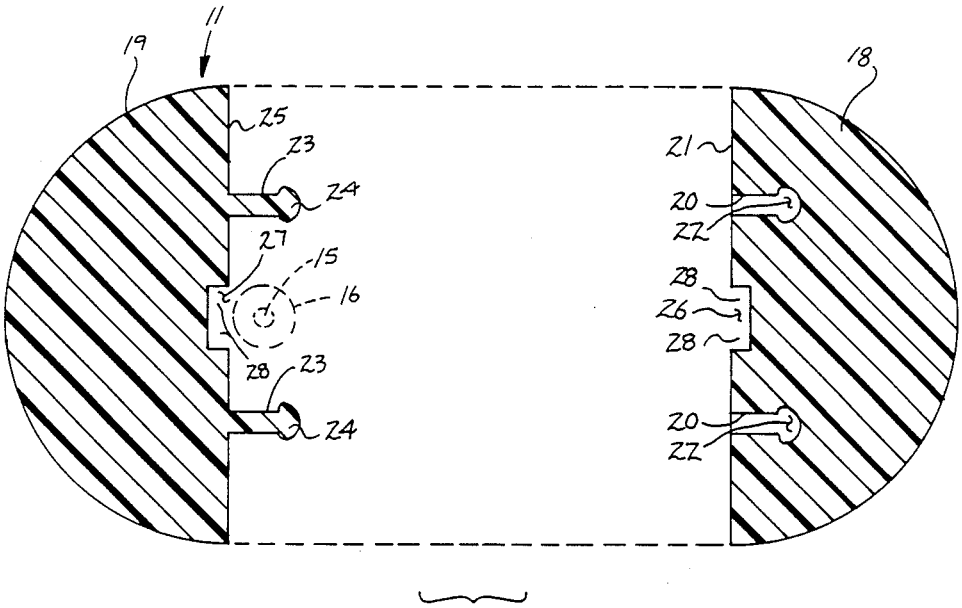
FIG. 6 is an orthographic view taken along the lines 6—6 of FIG. 5 in the direction indicated by the arrows.

Construction of the cylindrical securement head members 11 and 12 is exemplified in FIG. 6 wherein a forward hemisphere 18 is formed for securement with a rear hemisphere 19, wherein each hemisphere is provided with a respective first planar face 21 and a second planar face 25 securable together in an interlocking relationship to define a cylinder. A plurality of bores 20 of a first diameter and of a first length are positioned along a common diameter directed interiorly of the first planar face 21 of the forward hemisphere 18. Each bore terminates in a cavity 22 at each terminal end of each bore and is formed of a second diameter greater than the first diameter. The bores 20 and their associated cavities 22 are arranged to receive aligned first shafts 23 directed orthogonally outwardly of the second planar face 25 along a common diameter of the rear hemisphere 19. The first shafts 23 are of a first length equal to the first length of the bores 20 and terminate at their outer terminal ends in an enlarged tip member 24 defined by a second diameter equal to the second diameter of the cavities 22. As the hemispheres 18 and 19, and particularly the shafts 23 and their tip members 24, are formed of a flexible polymeric material, the tip members 24 are directed through associated bores 20 to be received in a complementary fashion within a respective second cavity 22. A plurality of cavities defined by a first cavity 26 and a second cavity 27 are positioned coaxially of each respective planar face 21 and 25. Each cavity 26 and 27 is formed with a series of pointed projections 28, wherein the projections extend below the respective surfaces of the first and second planar faces 21 and 25. When the hemispheres 18 and 19 are secured together, an associated tether line 14 or modified tether line 14*a* defined by the fibrous sheath and its associated wire core is positioned between the first and second cavities 26 and 27, the projections 28 pierce and secure the associated sheath portions of the tether lines to fixedly maintain an associated cylindrical head member in a predetermined and preselective relationship relative to an associated tether line, as illustrated in FIGS. 3 and 5. The respective first and second cavities 26 and 27 are coextensively formed along a further diameter of the respective first and second planar faces 21 and 25, wherein the further diameters are orthogonally offset relative to the diameters containing their respective bores 20 and the shafts 23 of the first and second planar faces, wherein the first and second cavities 26 and 27 receive the tether line 14 coextensively along the interior to capture the tether line within the cavities when the hemispheres are secured together.

Figure 7:
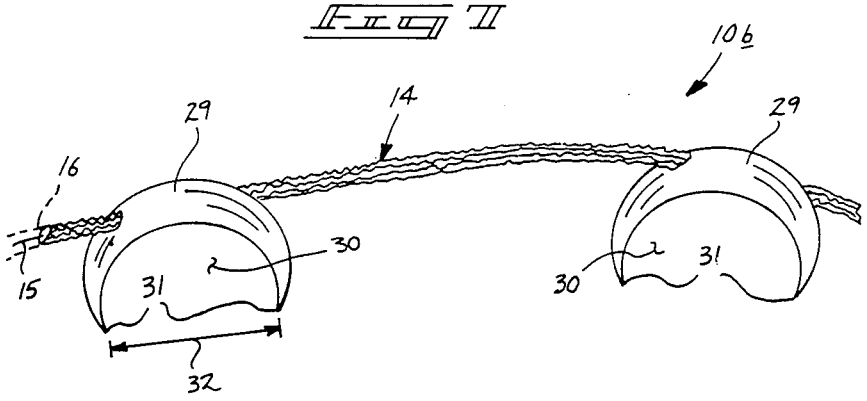
FIG. 7 is an isometric illustration of a further modified hair securement device of the instant invention.
Figure 8:
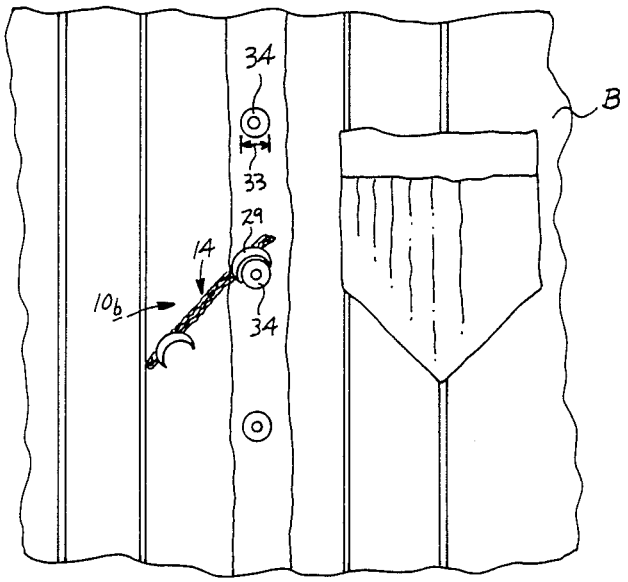
FIG. 8 is an orthographic view taken in elevation of the further modified hair securement device 10*b* of the instant invention in selective association with an article clothing for temporary storage thereof.

FIG. 7 illustrates a further modified hair securement device **10*b* incorporating a plurality of spaced crescent members 29 fixedly mounted to a tether line 14. The crescent members 29 are defined by a crescent shaped central body with pointed tip ends 31. The crescent members are formed of a resilient polymeric material and define the respective crescent member cavities 30 defining a circular segment greater than 180 degrees of arc. The pointed tip ends 31 are defined by a spacing 32 that is less than a predetermined diameter 33 of an associated button 34 of a garment of clothing, such as a blouse "B" as illustrated in FIG. 8. Accordingly, the crescent members 30 may be stored temporarily about a button "B" by flexibly spreading the tip ends 31 to receive a button 34 therewithin and inasmuch as the cavities define a circular segment greater than 180 degrees, they are thusly retained about the button until use of the modified hair securement device 10*b* is desired about an elongate hair bundle 7 in a manner as illustrated in FIG. 4**.

As to the manner of usage and operation of the present invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair securement device comprising, an elongate semi-rigid tether line of finite length defining a first end and a second end, and a first spherical means selectively securable to the tether line relative to the first end and a second spherical means selectively securable to the tether line relative to the second end, and the tether line defined by a malleable line with a central core encompassed by a flexible surrounding sheath, and wherein the central core is a metallic wire core and the flexible sheath is defined by a fabric sheath, and wherein the first and second securement spherical means are of identical construction, and each spherical means is defined by a first hemisphere and a second hemisphere selectively securable together, each hemisphere including a respective first planar face and a second planar face securable in face to face contact relative to one another for securement of the first hemisphere and the second hemisphere together, and wherein the first hemisphere includes a plurality of diametrically aligned bores directed orthogonally and interiorly of the first planar face and defined by a first length and by a first diameter, each bore terminating in an enlarged cavity of a second diameter greater than the first diameter, and the bores aligned for reception of a respective shaft member directed orthogonally outwardly of the second planar face and aligned along a diameter of the second planar face and defined by a spacing equal to a spacing between the bores, and each shaft defined by a diameter equal to the first diameter and of a length equal to the first length, and each shaft terminating in a flexible bulbous tip defined by a second diameter equal to the second diameter of each cavity, wherein each cavity is of a complementary configuration to each bulbous tip, and wherein the first planar face includes a first cavity axially positioned interiorly of the first planar face, and a second cavity axially aligned and positioned interiorly of the second planar face, and the first cavity and the second cavity including a series of projections directed outwardly of a floor of each cavity, and the projections defined by a length less than a depth defined by each of the first and second cavities, wherein upon securement of the first and second planar faces together, the projections pierce and anchor the tether line relative to the respective cavities, and the cavities are defined coextensively along a further diameter of each first and second planar face orthogonally aligned relative to the respective bores and shafts of the respective first and second planar faces.

* * * * *